US012454779B2

(12) United States Patent
Igawa et al.

(10) Patent No.: US 12,454,779 B2
(45) Date of Patent: Oct. 28, 2025

(54) SEWING MACHINE

(71) Applicant: JANOME Corporation, Tokyo (JP)

(72) Inventors: Takahito Igawa, Tokyo (JP); Jun Mafune, Tokyo (JP)

(73) Assignee: JANOME CORPORATION, Tokyo (JP)

( * ) Notice: Subject to any disclaimer, the term of this patent is extended or adjusted under 35 U.S.C. 154(b) by 0 days.

(21) Appl. No.: 18/678,046

(22) Filed: May 30, 2024

(65) Prior Publication Data

US 2025/0011989 A1 Jan. 9, 2025

(30) Foreign Application Priority Data

Jul. 7, 2023 (JP) ..... 2023-111993

(51) Int. Cl.
*D05B 19/14* (2006.01)
*D05B 19/00* (2006.01)

(52) U.S. Cl.
CPC ..... *D05B 19/14* (2013.01); *D05B 19/006* (2013.01); *D05D 2205/04* (2013.01); *D05D 2205/06* (2013.01)

(58) Field of Classification Search
CPC ..... D05B 19/006; D05B 19/12; D05B 19/14; D05D 2205/04; D05D 2205/06
See application file for complete search history.

(56) References Cited

U.S. PATENT DOCUMENTS 5,899,158 A * 5/1999 Yoshida ..... D05B 19/12 112/102.5
2007/0221108 A1* 9/2007 Koerner ..... D05B 11/00 112/119
2009/0007829 A1* 1/2009 Shimizu ..... D05B 69/14 112/277
2012/0006241 A1* 1/2012 Nishiyama ..... D05B 55/14 112/221
2018/0347087 A1* 12/2018 Imano ..... D05B 1/00

FOREIGN PATENT DOCUMENTS

JP 2002-292175 A 10/2002

* cited by examiner

*Primary Examiner* — Nathan E Durham
(74) *Attorney, Agent, or Firm* — MATTINGLY & MALUR, PC

(57) ABSTRACT

A sewing machine includes at least: a movement detection unit for detecting a movement amount of a material to be sewn; a drive motor for operating a needle; a control unit for operating the drive motor; and a storage unit. The storage unit stores a sewing speed and a sewing pitch. The control unit is configured to implement a first control mode and a second control mode. In the first control mode, the control unit operates the drive motor at the stored sewing speed when the detected value by the movement detection unit exceeds a predetermined first threshold. In the second control mode, the control unit operates the drive motor such that the sewing is carried out at the stored sewing pitch on the basis of the detected value when the detected value exceeds a predetermined second threshold. These first control mode and second control mode are switchable.

6 Claims, 9 Drawing Sheets

SEWING MACHINE

CROSS-REFERENCE TO RELATED APPLICATION

The present application claims priority from Japanese application JP2023-111993, filed on Jul. 7, 2023, the content of which is hereby incorporated by reference into this application.

TECHNICAL FIELD

The disclosure relates to a sewing machine.

BACKGROUND

For example, referring to Patent Document 1, a sewing machine is disclosed therein, which is provided with a detection device for detecting a movement amount of a cloth (in Patent Document 1, it is referred to as "device for measuring a distance") to determine a movement speed of the cloth. This sewing machine can control a sewing speed (a rotational rate for a sewing machine drive motor) in accordance with the movement speed, thereby allowing the sewing to be performed with a constant sewing pitch.

RELATED ART DOCUMENTS

Patent Documents

Patent Document 1: JP 2002-292175 A

The control of sewing speed according to a movement speed of a cloth as in the sewing machine of Patent Document 1 may result in lowering workability in some cases, e.g., a type of sewing (for example, variable zigzag sewing with a change in a sewing pitch) or user's skill or preference. The adjustment of a sewing speed by a user for such workability may bring complicated manipulation to the user. It is desirable to suppress the complication without reduction in workability in relation to different sewing types or user's skill or preference.

SUMMARY

As an example, the concepts according to the accompanying claims are adopted for solving the problem above. The present application includes a plurality of means and methods for solving the problem above. As an example thereof, the disclosure relates to a sewing machine. This sewing machine includes at least: a movement detection unit for detecting a movement amount of a material to be sewn; a drive motor for operating a needle; a control unit for operating the drive motor; and a storage unit. The storage unit stores a sewing speed and a sewing pitch. The control unit is configured to implement a first control mode and a second control mode. In the first control mode, the control unit operates the drive motor at the stored sewing speed when the detected value by the movement detection unit exceeds a predetermined first threshold. In the second control mode, the control unit operates the drive motor such that the sewing is carried out at the stored sewing pitch on the basis of the detected value by the movement detection unit when the detected value by the movement detection unit exceeds a predetermined second threshold. These first control mode and second control mode are switchable.

According to this sewing machine, different control modes are selectable in accordance with, for example, a type of sewing, and therefore workability is improved.

EMBODIMENTS

Hereinafter, embodiments of the disclosure will be described in conjunction with illustrative examples.

Figure 1:
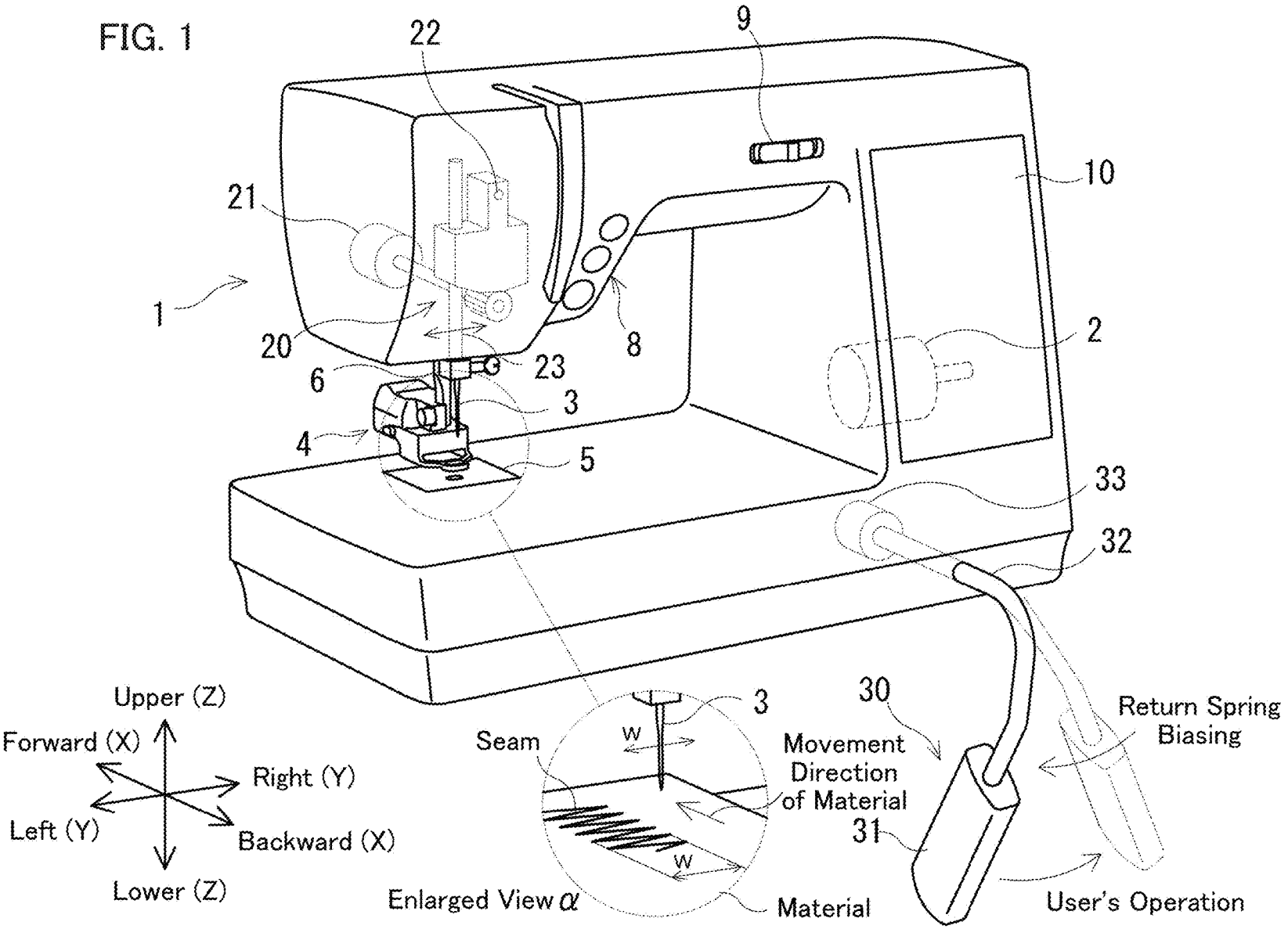
FIG. 1 shows an exemplary outline view of an embodiment of a sewing machine.

FIG. 1 shows an embodiment of a sewing machine. A sewing machine 1 operates a needle 3 through the well-known linkage (not shown) by means of a built-in drive motor 2. The sewing machine 1 performs a sewing operation in synchronization with a movement of a material to be sewn (not shown) when the material is pressed by a presser 4 and moved by a user (free motion sewing). In the sewing operation, an upper thread and a lower thread (not shown) are crossed to form a seam on the material. The upper thread is fed from a thread pool (not shown) and threaded through the needle 3. The lower thread is stored in a bobbin (not shown) placed inside the sewing machine 1. The material (for example, a cloth) is held between the presser 4 and a needle plate 5. The needle 3 is moved down by operation of the drive motor 2 and then penetrates the material to come close to the bobbin. The upper and lower threads are crossed by operation of a hook (not shown). Subsequently, the needle 3 moves up and comes out of the material and then a stitch is formed. In normal sewing that is not a free motion, the material is automatically fed forward at a predetermined distance by operation of an automatic feed mechanism (not shown), and then the next stitch is formed in the same manner. By repetition of this process, a straight unbroken sewing pattern with stitches at predetermined intervals is formed on the material. The distances between the stitches are referred to as "sewing pitch".

Figure 2:
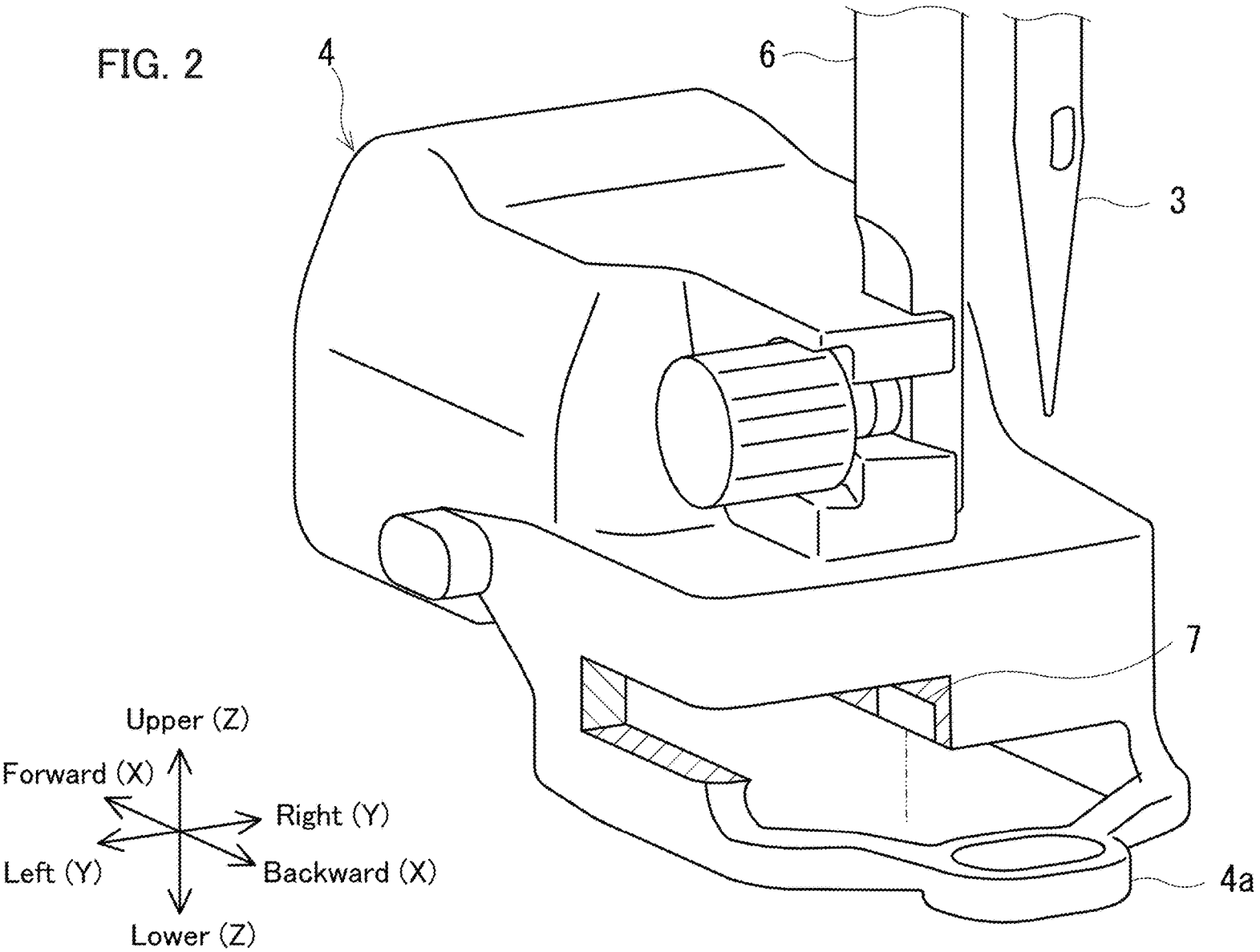
FIG. 2 shows an exemplary enlarged outline view of a portion including a presser with a partial cross-section.

In free motion sewing, a user conducts a sewing operation of the sewing machine 1, in which the user manually moves a material to be sewn without using the above-described automatic feed mechanism of the sewing machine 1, in order to form a desired sewing pattern, such as a curved line. The presser 4 shown in FIG. 1 is a suitable presser for this free motion sewing. FIG. 2 shows an enlarged view of the presser 4 in this embodiment (the hatched sections depict cross-sectional views).

The presser 4 is provided with a pressing part 4*a* having a circular hole. The material is placed between the pressing part 4*a* and the needle plate 5, and then the needle 3 is moved down through the hole of the pressing part 4*a* and stuck into the material. The pressing part 4*a* does not block the vertical movement of the needle 3 and it is positioned on the material at the periphery of the sticking point of the needle 3. This allows a vertical vibration of the material caused by the vertical movement of the needle 3 to be controlled and thus facilitates the formation of an assured seam. The presser 4 is attached to a presser bar 6 movable vertically in accordance with operation of the needle 3. The presser 4 is detachable for replacement with a presser for normal sewing. A suitable presser is selectable when the mode of the sewing machine 1 is switched between normal sewing and free motion sewing.

As illustrated in the cross-sectional view of FIG. 2, a sensor of a movement detection unit 7 is incorporated in the presser 4. The movement detection unit 7 for detecting movements of the material is configured with, for example, an image sensor. The movement detection unit 7 implements image processing of image data acquired by the image sensor imaging the surface of the material to obtain information on the movement of the material. Alternatively, an optical sensor may be used for the movement detection unit 7. The optical sensor may detect a surface profile of the material using visible light, infrared light, etc. to determine a movement amount of the material. In a further example, a movement detection unit may be provided with a built-in trackball in contact with the material so that a movement amount of the material is determined on the basis of rolling of the trackball according to a movement of the material.

In this embodiment, the movement detection unit 7 is incorporated in the detachable presser 4. However, in another example, the movement detection unit 7 may be provided in the body of the sewing machine 1. Moreover, the movement detection unit 7 is arranged over the material in this embodiment. However, in another example, the movement detection unit 7 may be arranged under a material to be sewn. In yet another example, the sewing machine 1 may be provided with a separated movement detection unit, which is wearable on a hand or arm of a user for detecting a motion of the hand or arm, thereby detecting indirectly a movement of a material to be sewn. In other examples, a movement detection unit may be attachable to a material to be sewn for detecting movements of the material, or operable in conjunction with an app using a camera of a smartphone or tablet for detecting motions of a hand of a user or movements of a material to be sewn.

The sewing machine 1 is provided with a start-stop key 8, a speed controller 9, a display 10 comprising a touch panel, at respective accessible positions for a user. The start-stop key 8 is used for starting/stopping a sewing operation and, in this embodiment, comprises push buttons. The speed controller 9 comprises a slidable knob in this embodiment, which is an analog device having a variable output according to a position of the knob slid laterally by a user. The slidable knob is illustrated in this embodiment. In another example, a rotatable knob may be used for the speed controller 9. Alternatively, the speed controller 9 may comprise a digital device, which implements digital signal processing of an input. In this embodiment, the display 10 comprises a liquid crystal panel display with a touch panel function. The display 10 displays functional and operational conditions of the sewing machine 1. The display 10 is also used for touch inputs of various parameters using a setup screen or the like. In particular, in this embodiment, a user may input a sewing speed and sewing pitch setting by touching a predetermined section of the display 10 which is displaying the setup screen.

The sewing machine 1 includes a needle lateral swing mechanism 20 (also referred to as "needle oscillating mechanism") for swinging the needle 3 in a lateral (left and right) direction (amplitude motion). The combination of the amplitude motion of the needle 3 by the needle lateral swing mechanism 20 with the sewing operation and feeding operation as described above allows a zigzag seam with a sewing width (amplitude) W to be formed (zigzag sewing), for example as shown in the partially enlarged view a in FIG. 1. It is also possible to perform variable zigzag sewing by use of a free motion operation, in which a user can conduct zigzag sewing as changing the sewing width W in free motion sewing.

The needle lateral swing mechanism 20 is operated by means of an amplitude motor 21, which comprises, for example, a stepping motor. In an example, the needle lateral swing mechanism 20 has a gear engaging with a gear of the amplitude motor 21, and thereby swings around a pivot shaft 22 in accordance with a rotational angle of the amplitude motor 21. The rotational angle of the amplitude motor 21 (in this example, a step angle of the stepping motor) is controlled as a driving amount for the amplitude motor 21. The needle lateral swing mechanism 20 holds a needle bar 23 extending in a vertical direction. The needle bar 23 is operated in an amplitude motion in accordance with a swing motion of the needle lateral swing mechanism 20. The needle 3 attached to the needle bar 23 is thereby operated in an amplitude motion. Accordingly, an amplitude amount of the needle 3, i.e., the sewing width W, is controllable in accordance with the control of the driving amount of the amplitude motor 21.

The sewing machine 1 includes a knee operable device (herein referred to as "knee lifter") 30 as one of operable devices operated by a user. The knee lifter 30 has a pad 31 manipulatable by a knee of a sitting user (a right knee in the example shown in FIG. 1). The knee lifter 30 is rotated around an operation shaft 32 in response to the manipulation by the user, and an amount of the rotation is detected as an operation amount by encoder 33. The operation amount is transmitted as an analog signal or digital signal to the control unit described below. The pad 31 is biased to the initial position by a return spring (not shown). The user manipulates the pad 31 against this biasing force. The pad 31 returns to the initial position depending on the biasing force when the user moves the knee away from the pad 31. Hand operation is not required for the knee lifter 30, and therefore the user can operate it even during sewing. Accordingly, for example, the user can change the sewing width W of zigzag sewing by the manipulation of the knee lifter 30 during a free motion sewing.

Figure 3:
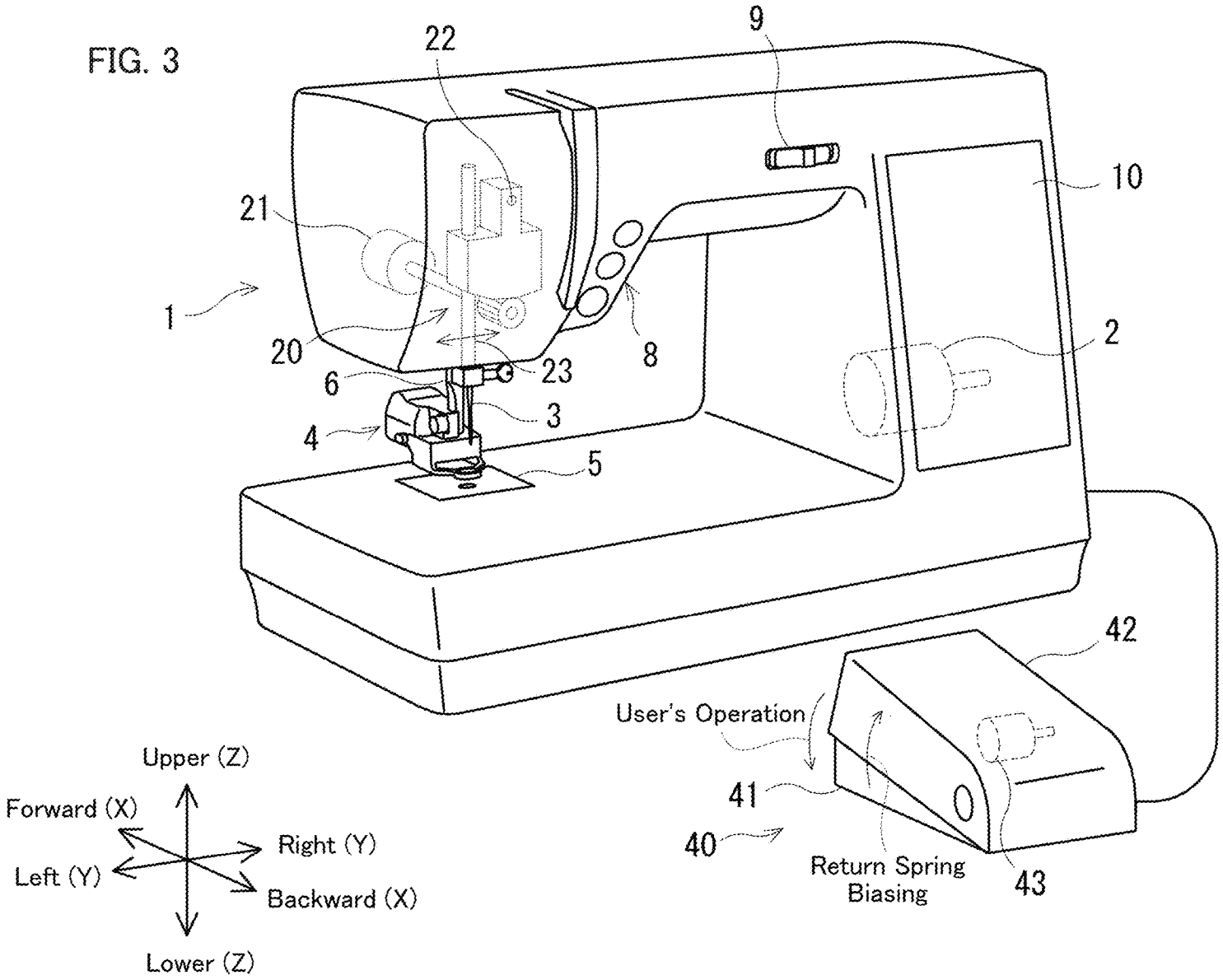
FIG. 3 shows an exemplary outline view of another embodiment of a sewing machine.

In addition, as shown in FIG. 3, a foot operable device (herein referred to as "foot controller") 40 as one of operable devices may be connected through an input/output terminal to the sewing machine 1. The foot controller 40 has a footboard 42, which is pivotally attached in a swingable manner to a base 41. The footboard 42 is biased to return when a user moves a foot away from it. The user depresses the footboard 42 against the biasing force to generate an output. The foot controller 40 has a built-in encoder 43 in the base 41. The output may be an analog signal or digital information. A sewing operation may be started in response to the depression of the footboard 42, and the sewing operation may be stopped in response to the release of the depression. A sewing speed may be regulated in accordance with a depression amount of the footboard 42.

For instance, a user, who is conducting the variable zigzag sewing, needs to move a material to be sewn by the user's hands in a sewing direction as well as operating the knee lifter 30 and the foot controller 40 as described above. Further, at the start of sewing or at the end of sewing, the user also needs to operate the operable devices, such as the start-stop key 8. For this reason, the variable zigzag sewing is cumbersome overall in operation, and hence there is a need to improve the operability.

Embodiment of the Control Unit

Figure 4:
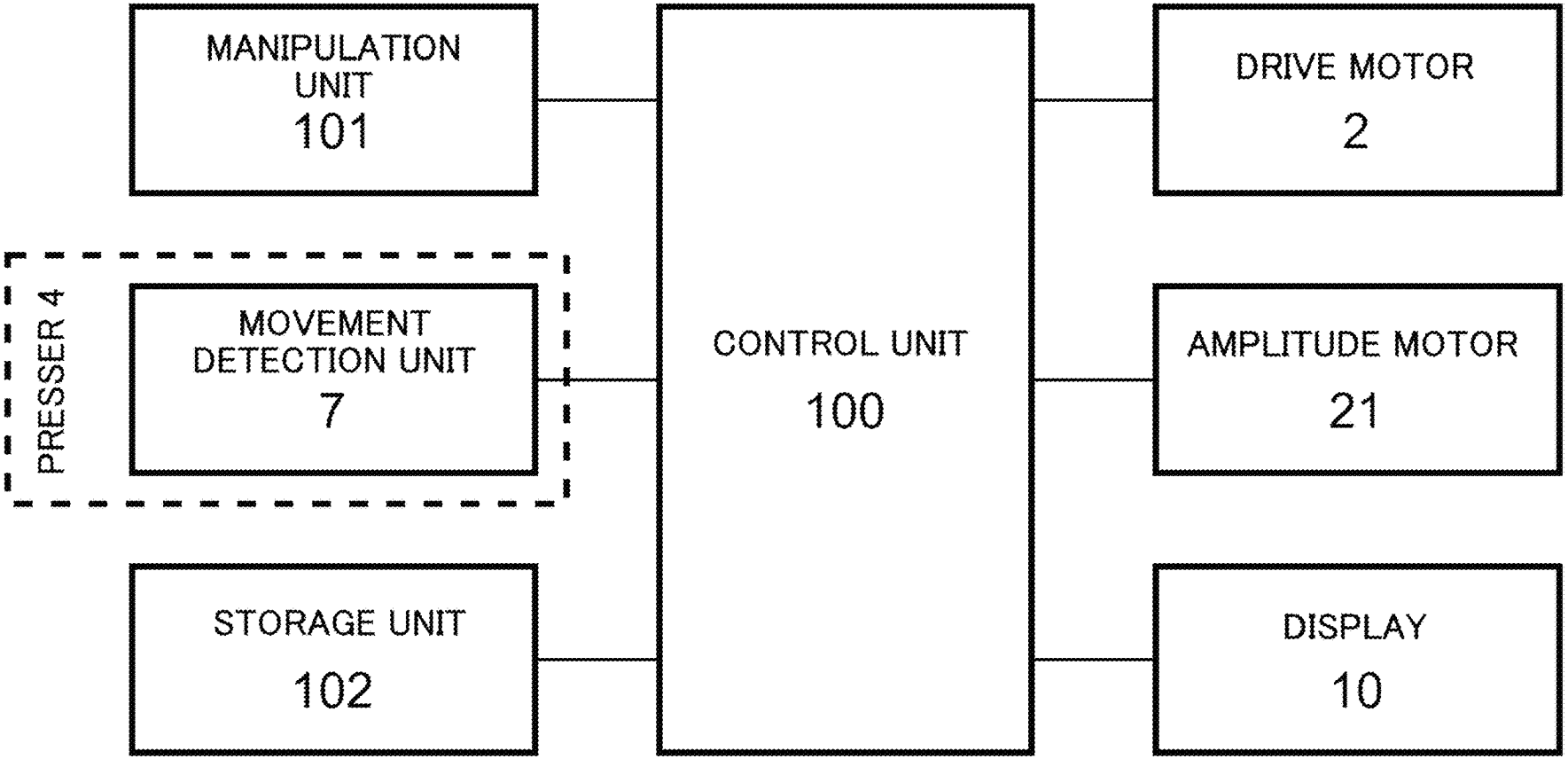
FIG. 4 shows an exemplary block diagram of an embodiment of a control unit and peripheral devices.

FIG. 4 shows a block diagram of an embodiment of a control unit 100 and peripheral devices on the sewing machine 1, which are configured to control a sewing operation. The control unit 100 consists of a processor (CPU) comprising, for example, ASIC (Application Specific Integrated Circuit), FPGA (Field-Programmable Gate Array), or PLC (Programmable Logic Controller). The control unit 100 controls a sewing operation when implementing a computer program stored in an external or internal memory.

The control unit 100 controls a manipulation unit 101 and the display 10, and receives signals output from the manipulation unit 101 and the display 10. The manipulation unit 101 includes the start-stop key 8, the speed controller 9, the knee lifter 30, and the foot controller 40 as described above. A storage unit 102 is connected to the control unit 100. The storage unit 102 has areas for storing a sewing speed Rset (setting value), a first threshold Vh1, a second threshold Vh2 and a third threshold Vh3 (corresponding to thresholds for a movement speed V of a material to be sewn, respectively, in this embodiment) with respect to the detected value by the movement detection unit 7, an acceleration period T, and an upper limit sewing speed Rlimit and a sewing starting speed Rstart, as described later. These respective areas may be also referred to as "sewing speed setup device", "threshold setup device", "acceleration period setup device", and "upper-limit/starting sewing speed setup device". In another embodiment, the sewing speed setup device, the threshold setup device, the acceleration period setup device, and the upper-limit/starting sewing speed setup device may be provided as hardware modules or software modules separately from the storage unit 102. Each "device" may be also referred to as "part", "unit", "module", or "system".

A sewing pitch setup unit (not shown) for setting a sewing pitch as described later may be also connected to the control unit 100. A sewing pitch is set by the sewing pitch setup unit on the basis of a user input through the display 10. The sewing pitch setting value may be stored in one area of the storage unit 102. This area may be also referred to as "pitch setup device."

The control unit 100 operates the drive motor 2 and the amplitude motor 21 in conjunction with the above devices. In an example, the storage unit 102 or the sewing pitch setup unit may comprise a hardware module on the control unit 100 or a device separated from the control unit 100.

[First Control Mode]

Figure 5:
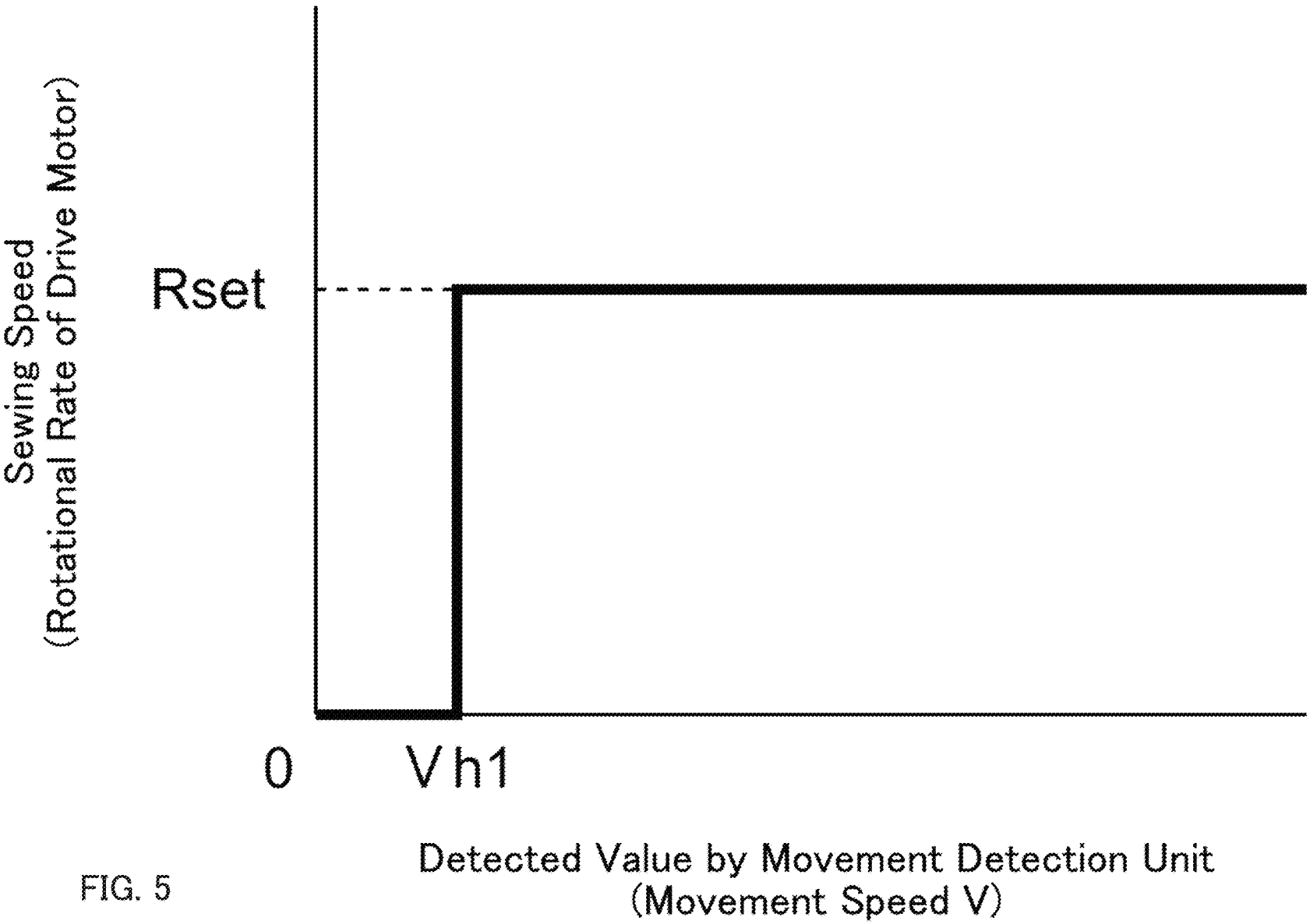
FIG. 5 illustrates an exemplary process of a sewing speed control according to a first control mode.

In a control mode for the free motion sewing including the variable zigzag sewing as described above, the control unit 100 controls the drive motor 2 as illustrated in FIG. 5. First, a material to be sewn is placed by a user at a predetermined position of the sewing machine 1. In this embodiment, the material is placed between the needle plate 5 and the presser 4, and the sewing start portion of the material is positioned just under the needle 3. Then, the user manipulates the speed controller 9 to determine the sewing speed Rset. The sewing speed Rset corresponding to the position of the speed controller 9 is stored in the storage unit 102. At this stage, the sewing machine 1 is in a stopped state.

Subsequently, when the start-stop key 8 is manipulated by the user, the sewing machine 1 is brought into a standby state and then the movement detection unit 7 starts to detect movements of the material. Before the user starts to move the material, in other words, while the movement detection unit 7 does not detect any movement of the material, the drive motor 2 is still in the stopped state and the needle 3 is not operated. When the user starts to move the material, the stopped state of the drive motor 2 is kept before the detected value by the movement detection unit 7 exceeds the predetermined first threshold Vh1 stored in the storage unit 102. Thereafter, when the detected value by the movement detection unit 7 reaches or exceeds the first threshold Vh1, the drive motor 2 is operated on the basis of the sewing speed Rset and the sewing operation is automatically started. In this embodiment, the detected value by the movement detection unit 7 corresponds to the movement speed V of the material, which is calculated from a movement amount of the material per unit time obtained from the output of the movement detection unit 7. The sewing speed corresponds to the rotational rate of the drive motor 2. In other embodiments, the detected value by the movement detection unit 7 may be a movement amount of the material or a movement acceleration calculated from the movement amount.

When the movement of the material is stopped, for example, at the end of the sewing, the drive motor 2 is stopped when the detected value by the movement detection unit 7 sinks below the first threshold Vh1. Then, the sewing operation is automatically stopped and the sewing machine 1 is brought into a standby state. The standby state is cleared when the user manipulates the start-stop key 8 again, and then the sewing machine 1 is brought into a stopped state and the sewing is completed.

During the sewing operation after the detected value by the movement detection unit 7 reaches or exceeds the first threshold Vh1, if the user operates the knee lifter 30 as described above, the zigzag sewing is performed and the sewing width W of the zigzag sewing can be changed.

In other words, in the first control mode, when the knee lifter 30 is operated while the rotational rate of the drive motor 2 is controlled on the basis of the sewing speed Rset to perform the free motion sewing, the control unit 100 changes the driving amount for the amplitude motor 21 on the basis of the operation amount of the knee lifter 30. This allows for a user designated sewing width W in the variable zigzag sewing.

In the variable zigzag sewing, the control unit 100 can constrain the sewing speed in order to perform steady sewing, because a higher sewing speed may make the sewing seam irregular when the sewing width W is increased. The upper limit sewing speed Rlimit for this purpose is stored in the storage unit 102. The upper limit sewing speed Rlimit is associated with the sewing width W, i.e., the driving amount for the amplitude motor 21 (or the operation amount of the knee lifter 30). The control unit 100 compares the upper limit sewing speed Rlimit with the sewing speed Rset with respect to the current driving amount for the amplitude motor 21. If the upper limit sewing speed Rlimit is lower than the sewing speed Rset, the control unit 100 operates the drive motor 2 at the upper limit sewing speed Rlimit. In this exemplary control, the upper limit sewing speed Rlimit corresponds to the upper limit rotational rate of the drive motor 2.

In the above-described first control mode, the first threshold Vh1 may be set to zero. However, when any threshold other than zero is set, an "allowance" can be applied as a safety margin until the drive motor 2 starts to operate (the needle 3 starts to move) after the user starts to move the material. The value of the first threshold Vh1 may be selectable by the user through the manipulation unit 101 or the display 10.

Embodiment 1 of First Control Mode

Figure 6:
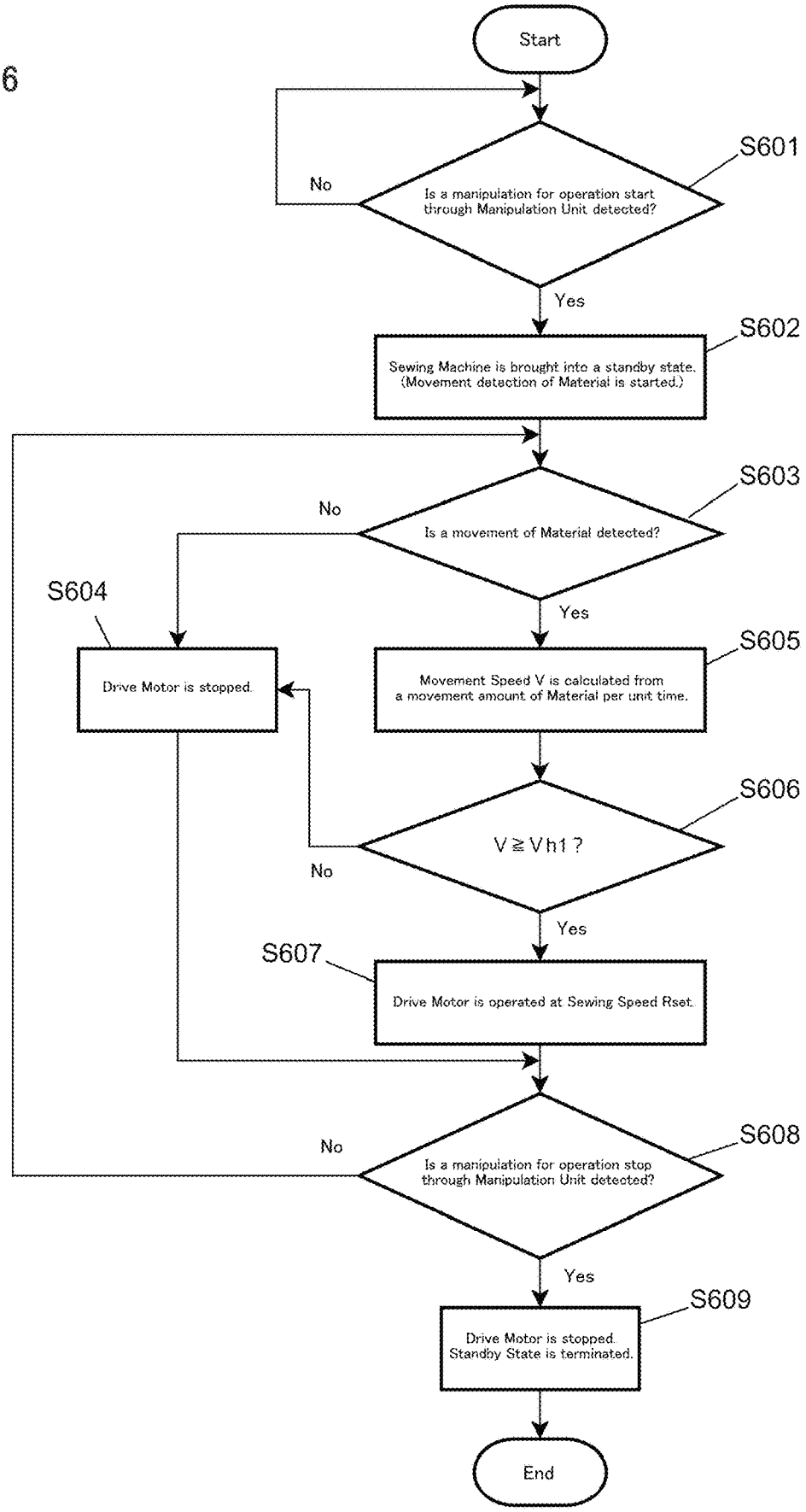
FIG. 6 shows an exemplary flowchart illustrating Embodiment 1 of the first control mode implemented by the control unit.

Embodiment 1 of the first control mode implemented by the control unit 100 according to the program will be described with reference to the flowchart as shown in FIG. 6.

Start: The sewing machine 1 is powered on, but the sewing machine 1 is in a stopped state because a user does not start the free motion sewing operation yet.

Subsequently, the control unit 100 monitors any manipulation for operation start (S601), for example, the manipulation of the start-stop key 8 of the manipulation unit 101. The manipulation for operation start of the manipulation unit 101 is not limited to the manipulation of the start-stop key 8 (pushing its button). In another example, the depression of the foot controller 40 may be detected as the manipulation for operation start. If such a manipulation for operation start is not detected (No), step S601 is repeated.

If the manipulation for operation start through the manipulation unit 101 is detected (Yes), the control unit 100 starts the movement detection of a material to be sewn by means of the movement detection unit 7, and brings the sewing machine 1 into a standby state (S602). In this step S602, although the sewing machine 1 is ready to perform the sewing, the user has not yet moved the material and the drive motor 2 is stopped.

The control unit 100 then monitors a movement of the material by means of the movement detection unit 7 (S603). If any movement of the material is not detected by the movement detection unit 7 (No), the control unit 100 stops the drive motor 2 (S604). If a movement of the material is detected by the movement detection unit 7 as the user starts to move the material (Yes), the control unit 100 acquires a movement amount of the material per unit time from the output of the movement detection unit 7 to calculate the movement speed V of the material from the movement amount (S605).

Subsequently, the control unit 100 compares the calculated movement speed V with the first threshold Vh1 stored in the storage unit 102 (S606). As the result of this comparison, if the movement speed V does not reach the first threshold Vh1 (V<Vh1), the control unit 100 stops the drive motor 2 (S604).

If the movement speed V reaches or exceeds the first threshold Vh1 (V≥Vh1), the control unit 100 controls the rotational rate of the drive motor 2 on the basis of the sewing speed Rset stored in the storage unit 102 (S607). In this step, the free motion sewing is performed and it is also possible to perform the variable zigzag sewing.

After stopping the drive motor 2 at step S604, or after operating the drive motor 2 at the sewing speed Rset at step S607, the control unit 100 monitors whether a manipulation for operation stop by the user is detected through the manipulation unit 101 (S608). For example, the manipulation for operation stop of the manipulation unit 101 may be the manipulation of the start-stop key 8 (pushing its button) or the release of the foot controller 40. If any manipulation for operation stop is not detected (No), the controller 100 repeats step S603 and the subsequent steps. If the manipulation for operation stop is detected (Yes), the control unit 100 stops the drive motor 2 and terminates the standby state (S609).

[Second Control Mode]

The control unit 100 can implement a second control mode different from the first control mode as described above, for the free motion sewing. For example, the control unit 100 may be configured to select one of these modes in response to a user's input via the display 10. In the first control mode according to Embodiment 1 as described above, the operation of the needle 3 may correspond to a constant speed control. In the second control mode as described below, the drive motor 2 is operated at a sewing speed Rverb that is proportional to the detected value by the movement detection unit 7 (the movement speed V of the material in this embodiment). Stitching with a predetermined interval (constant stitching) is thereby formed. The second control mode will be described with reference to FIG. 7.

When the start-stop key 8 is manipulated by a user after the maximum sewing speed Rmax is determined on the basis of the position of the speed controller 9, the movement detection unit 7 starts to detect movements of a material to be sewn. A user designated sewing pitch is set by the sewing pitch setup unit as described above. The maximum sewing speed Rmax is stored in an area of the storage unit 102, for example. This area may be also referred to as "maximum sewing speed setup device". In another embodiment, a maximum sewing speed setup device may be provided as a hardware or software module separate from the storage unit 102.

Figure 7:
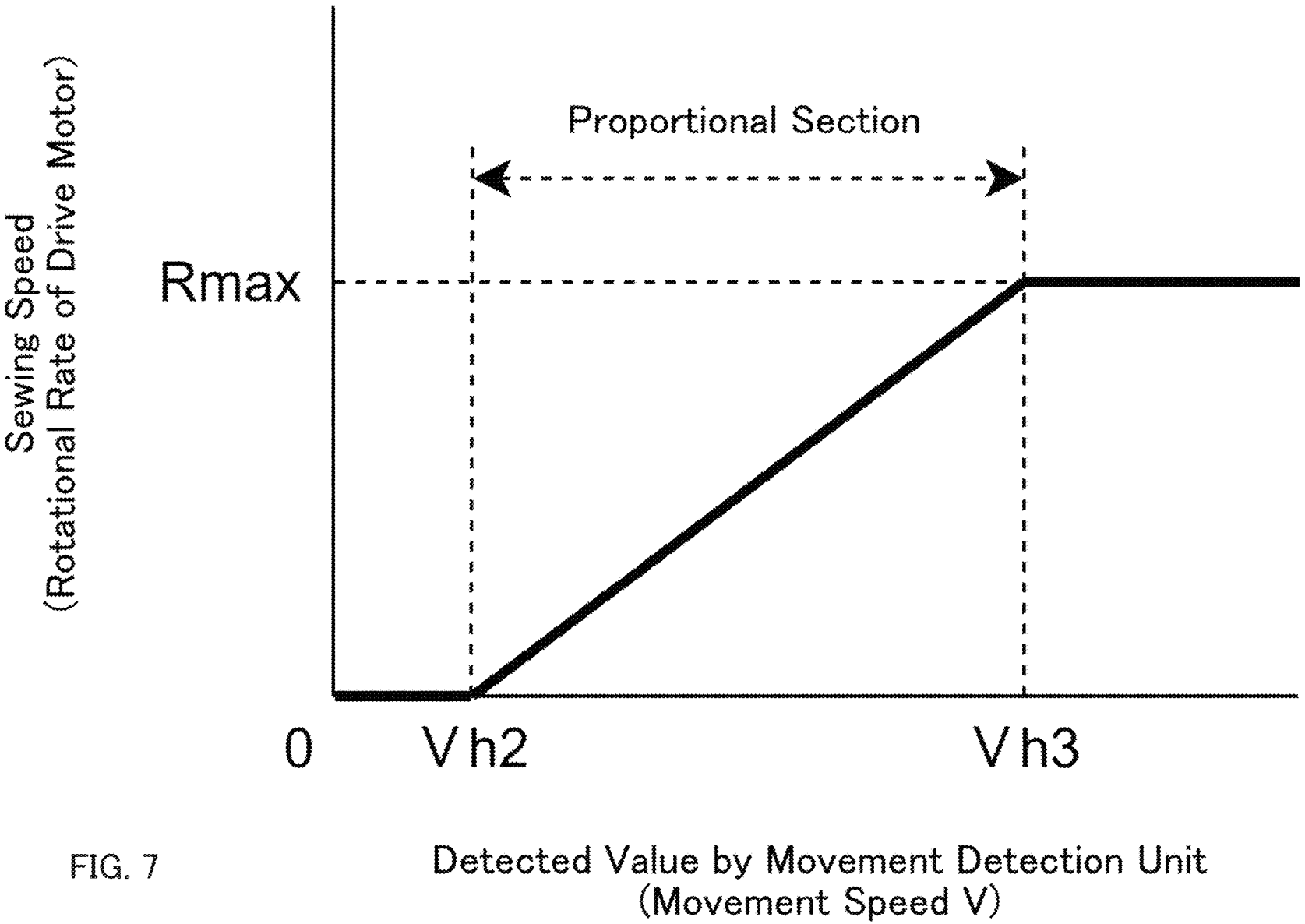
FIG. 7 illustrates an exemplary process of a sewing speed control according to a second control mode.

After the user starts to move the material, the drive motor 2 is in a stopped state before the detected value by the movement detection unit 7 (the moving velocity V of the material in this embodiment) exceeds the second threshold Vh2 stored in the storage unit 102. When the movement speed V reaches or exceeds the second threshold Vh2, the control unit 100 starts to operate the drive motor 2. The control unit 100 then operates the drive motor 2 at the sewing speed Rverb proportional to the movement speed V (the proportional section as shown in FIG. 7) so that the sewing is performed with the set sewing pitch amount. In other words, the control unit 100 calculates the sewing speed Rverb from the set sewing pitch amount and the movement speed V.

When the movement speed V of the material moved by the user is further increased and reaches the third threshold Vh3 stored in the storage unit 102, the control unit 100 operates the drive motor 2 at the maximum sewing speed Rmax. The maximum sewing speed Rmax in this step corresponds to the maximum value of the rotational rate of the drive motor 2.

The second threshold Vh2 for the second control mode is basically the same value as the first threshold Vh1 for the first control mode (the first threshold Vh1 can be used as the second threshold Vh2). In another example, these values may be different from each other. The third threshold Vh3 is higher than the second threshold Vh2.

Embodiment 1 of Second Control Mode

Figure 8:
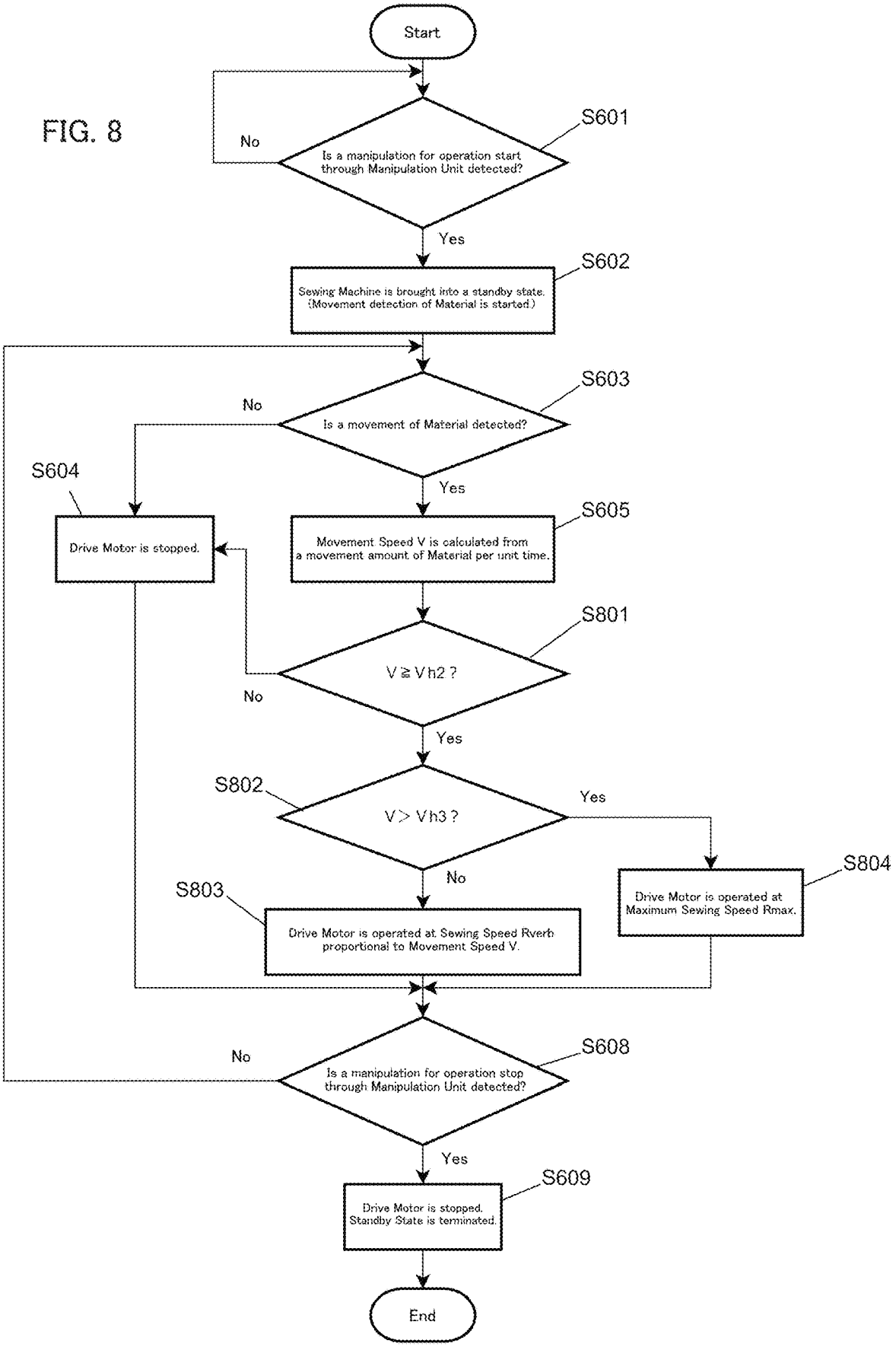
FIG. 8 shows an exemplary flowchart illustrating Embodiment 1 of the second control mode implemented by the control unit.

Embodiment 1 of the second control mode implemented by the control unit 100 according to the program will be described with reference to the flowchart as shown in FIG. 8.

The start step is implemented as with Embodiment 1 of the first control mode. After this, steps from S601 to S605, S608 and S609 as indicated with the same reference numbers as in FIG. 6 correspond to the respective steps having the same reference numbers in Embodiment 1 of the first control mode. For this reason, new steps from S801 to S804 are mainly described.

The control unit 100 calculates the movement speed V of a material to be sewn on the basis of a movement amount of the material (S605), and then compares the movement speed V with the second threshold Vh2 (S801). As the result of the comparison, if the movement speed V does not reach the second threshold Vh2 (V<Vh2), the control unit 100 stops the drive motor 2 (S604). If the movement speed V reaches or exceeds the second threshold Vh2 (V≥Vh2), the controller 100 compares the movement speed V with the third threshold Vh3 (S802).

As the result of the comparison, if the moving speed V is equal to or less than the third threshold Vh3 (V≤Vh3), the control unit 100 operates the drive motor 2 at the sewing speed Rverb proportional to the movement speed V (S803) so that the sewing is performed with the sewing pitch set by the sewing pitch setup device. If the movement speed V is more than the third threshold Vh3 (V>Vh3), the control unit 100 operates the drive motor 2 at the maximum sewing speed Rmax (S804). The maximum sewing speed Rmax is an upper limit speed for the free motion sewing. For example, the maximum sewing speed may be preliminarily stored in the storage unit 102 as a hardware-limit rotational rate of the drive motor 2 (response performance, etc.). In another example, the maximum sewing speed may be a maximum rotational rate preliminarily set by a user in view of the user's skill or the like.

Embodiment 2 of First Control Mode

Figure 9:
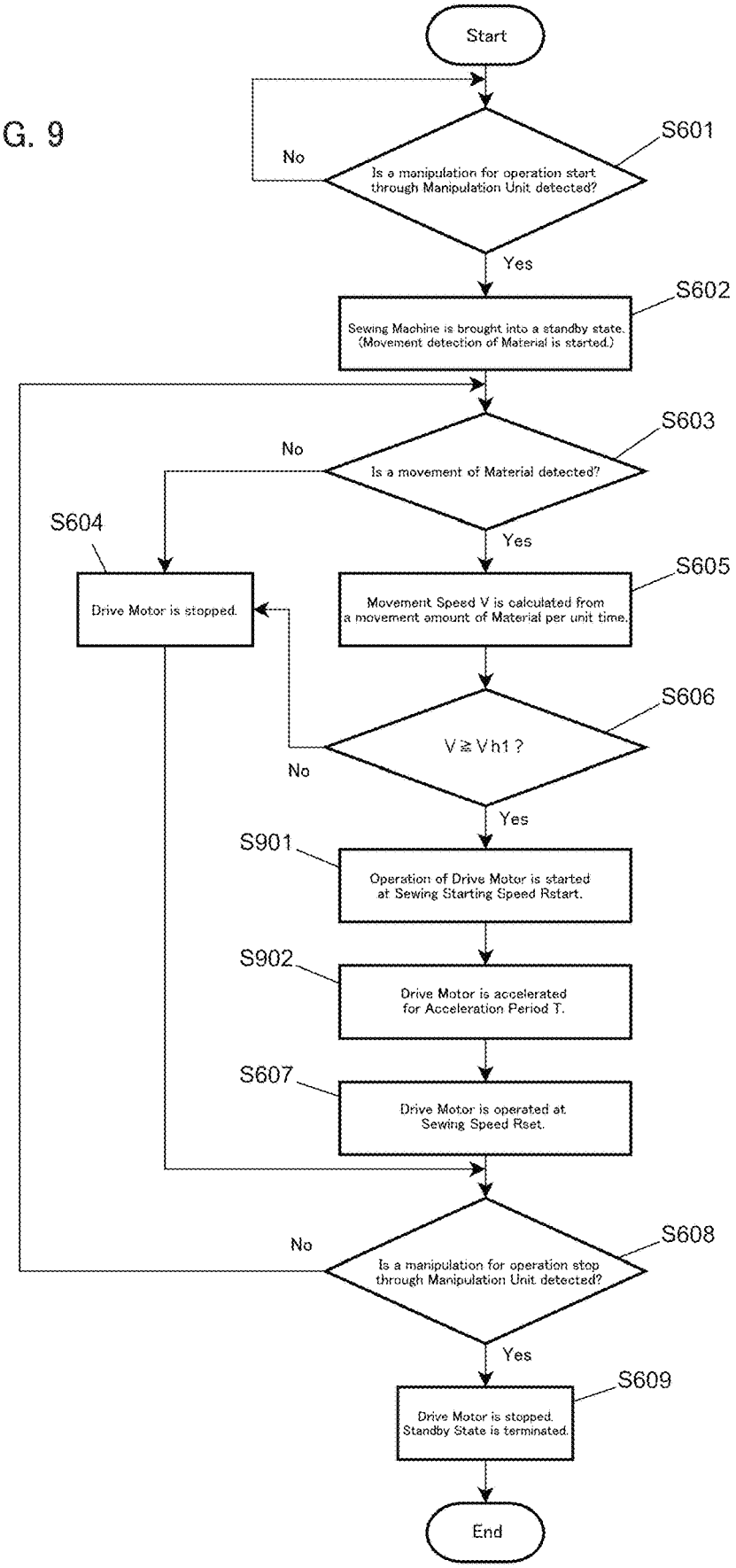
FIG. 9 shows an exemplary flowchart illustrating Embodiment 2 of the first control mode implemented by the control unit.

Embodiment 2 of the first control mode implemented by the control unit 100 according to the program will be described with reference to the flowchart as shown in FIG. 9.

The start step is implemented as with Embodiment 1 of the first control mode. After this, steps from S601 to S606 and from S607 to S609 as indicated with the same reference numbers as in Embodiment 1 correspond to the respective steps having the same reference numbers in Embodiment 1. For this reason, new steps S901 and S902 are mainly described.

In Embodiment 2, the storage unit 102 stores the sewing starting speed Rstart and the acceleration period T. After the movement speed V reaches or exceeds the first threshold Vh1 (S606), the control unit 100 controls the rotational rate of the drive motor 2 on the basis of the sewing starting speed Rstart stored in the storage unit 102 and starts to operate the drive motor 2 (S901). Subsequently, the control unit 100 increases the rotational rate of the drive motor 2 (in other words, accelerates the drive motor 2) for the acceleration period T stored in the storage unit 102 (S902). After the acceleration period T, the control unit 100 controls the rotational rate of the drive motor 2 on the basis of the sewing speed Rset (S607). According to Embodiment 2, the operation of the needle 3 is not started at the sewing speed Rset. In Embodiment 2, the sewing speed is gradually increased for the acceleration period T. Consequently, the operation of the needle 3 is started in a slower manner, and this causes a sense of security.

According to the embodiments with reference to the examples, the sewing machine 1 is configured to be switchable between the first control mode and the second control mode in accordance with different sewing types or user's preference, and therefore workability is improved. Further, the sewing machine 1 is configured to detect a start and a stop of movement of a material to be sewn by a user, and automatically control a start and a stop of sewing operation in accordance with the start and the stop of movement. This also allows for improvement in workability. The selection of the first control mode and the second control mode may be made in the stopped state of the sewing machine (before the manipulation for operation start) or may be made in the standby state of the sewing.

The disclosed embodiments are not limited to the above-described examples, and may include various modifications. For example, the above-described examples have been described in detail for easy understanding of the embodiments, but the examples are not necessarily limited to those having all the described configurations. A component or components of some of the examples can be replaced with the component or components of another example, and a component or components of some of the examples can be added to one of the examples. For a component or components of the respective examples, the addition of different component(s), deletion or replacement can be made.

Some or all of the above-described configurations, functions, processing units, processing means, and the like may be implemented using hardware, for example, by designing with an integrated circuit. Alternatively, the above-described configurations, functions, and the like may be implemented using software executed by a processor interpreting and executing programs for implementing the respective functions. Information such as a program, a table, and a file for implementing each function can be stored in a storage such as a memory, a hard disk, and a solid state drive (SSD), or a recording medium such as an IC card, an SD card, and a DVD.

Connection line, control line, information line, etc. shows what are considered to be necessary for the explanation, not necessarily all on the product. In practice, almost all of the configurations may be considered to be connected to each other.

The above-described embodiments disclose at least the following concepts.

[1] A sewing machine 1 comprising:

a movement detection unit 7 for detecting a movement amount of a material to be sewn;

a drive motor 2 for operating a needle;

a control unit 100 for operating the drive motor 2; and a storage unit 102, wherein the storage unit 102 stores a sewing speed Rset and a sewing pitch, wherein the control unit 100 is configured to implement a first control mode and a second control mode, wherein in the first control mode, the control unit 100 operates the drive motor 2 at the stored sewing speed Rset when the detected value by the movement detection unit 7 exceeds a predetermined first threshold Vh1, wherein in the second control mode, the control unit 100 operates the drive motor 2 such that sewing is carried out at the stored sewing pitch on the basis of the detected value by the movement detection unit 7 when the detected value by the movement detection unit 7 exceeds a predetermined second threshold Vh2, wherein the first control mode and the second control mode for the control unit 100 are switchable.

[2] The second threshold Vh2 in the second control mode is equal to the first threshold Vh1 in the first control mode.

[3] The sewing machine 1 further comprises a needle lateral swing mechanism 20, an amplitude motor 21 for operating the needle lateral swing mechanism 20, and a manipulation unit 101 manipulated by a user, wherein the control unit 100 operates the amplitude motor 21 on the basis of an operation amount of the manipulation unit 101.

[4] The storage unit 102 stores an upper limit sewing speed Rlimit based on a driving amount for the amplitude motor 21, wherein the control unit 100 operates the drive motor 2 at the upper limit sewing speed Rlimit when the upper limit sewing speed Rlimit is lower than the sewing speed Rset.

[5] The storage unit 102 stores a sewing starting speed Rstart and a predetermined acceleration period T, wherein the control unit 100, in the first control mode, starts to operate the drive motor 2 at the sewing starting speed Rstart when the detected value by the movement detection unit 7 exceeds the first threshold Vh1, and then operates the drive motor 2 to achieve the stored sewing speed Rset after the acceleration period T.

[6] A computer program (or a computer program product or a computer-readable storage containing a program) which is executable on the control unit 100 of the sewing machine 1 according to any one of [1] to [5] above, wherein when executed by the control unit 100, the computer program causes the control unit 100 to implement the first control mode or the second control mode.

The embodiments have been described with reference to several examples. However, other than the examples, various embodiments can be conceived on the basis of the scope understood in the above description.

What is claimed is:

1. A sewing machine comprising:

a movement detection unit for sensing a movement of a material to be sewn to detect a movement amount of the material;

a drive motor for operating a needle;

a control unit for operating the drive motor; and a storage unit, wherein the storage unit stores a sewing speed and a sewing pitch, wherein the control unit is configured to implement a first control mode and a second control mode, wherein in the first control mode, when a detected value by the movement detection unit indicates a start of the movement of the material, the control unit keeps a stopped state of the drive motor until the detected value by the movement detection unit reaches a predetermined first threshold, and then operates the drive motor at the stored sewing speed when a detected value by the movement detection unit exceeds the first threshold, wherein in the second control mode, when a detected value by the movement detection unit indicates a start of the movement of the material, the control unit keeps a stopped state of the drive motor until the detected value by the movement detection unit reaches a predetermined second threshold, and then operates the drive motor such that sewing is carried out at the stored sewing pitch on the basis of a detected value by the movement detection unit when the detected value by the movement detection unit exceeds the second threshold, and wherein the first control mode and the second control mode for the control unit are switchable.

2. The sewing machine according to claim 1, wherein the second threshold is equal to the first threshold.

3. The sewing machine according to claim 1, further comprising:

a needle lateral swing mechanism;

an amplitude motor for operating the needle lateral swing mechanism; and a manipulation unit manipulated by a user, wherein the control unit operates the amplitude motor on the basis of an operation amount of the manipulation unit.

4. The sewing machine according to claim 3, wherein the storage unit stores an upper limit sewing speed based on a driving amount for the amplitude motor, wherein the control unit operates the drive motor at the upper limit sewing speed when the upper limit sewing speed is lower than the sewing speed.

5. The sewing machine according to claim 1, wherein the storage unit stores a sewing starting speed and a predetermined acceleration period, wherein the control unit, in the first control mode, starts to operate the drive motor at the sewing starting speed when the detected value by the movement detection unit exceeds the first threshold, and then operates the drive motor to achieve the stored sewing speed after the acceleration period.

6. A non-transitory computer-readable medium containing a computer program executable on a control unit of a sewing machine, the sewing machine comprising: a movement detection unit for sensing a movement of a material to be sewn to detect a movement amount of the material; a drive motor for operating a needle; and a storage unit for storing a sewing speed and a sewing pitch, wherein the control unit is configured to operate the drive motor, wherein when executed by the control unit, the computer program causes the control unit to implement a first control mode or a second control mode, wherein in the first control mode, when a detected value by the movement detection unit indicates a start of the movement of the material, the control unit keeps a stopped state of the drive motor until the detected value by the movement detection unit reaches a predetermined first threshold, and then operates the drive motor at the stored sewing speed when a detected value by the movement detection unit exceeds the first threshold, wherein in the second control mode, when a detected value by the movement detection unit indicates a start of the movement of the material, the control unit keeps a stopped state of the drive motor until the detected value by the movement detection unit reaches a predetermined second threshold, and then operates the drive motor such that sewing is carried out at the stored sewing pitch on the basis of a detected value by the movement detection unit when the detected value by the movement detection unit exceeds the second threshold, and wherein the first control mode and the second control mode for the control unit are switchable.

* * * * *